United States Patent [19]

Roberts

[11] 3,999,343

[45] Dec. 28, 1976

[54] PARTITION AND STUD THEREFOR

[75] Inventor: James R. Roberts, Palatine, Ill.

[73] Assignee: United States Gypsum Company, Chicago, Ill.

[22] Filed: June 24, 1975

[21] Appl. No.: 589,827

Related U.S. Application Data

[63] Continuation of Ser. No. 435,078, Jan. 1, 1974, abandoned.

[52] U.S. Cl. ..... 52/241; 52/481

[51] Int. Cl.[2] ..... E04H 1/00

[58] Field of Search ..... 52/481, 144, 145, 730, 52/346, 347, 729, 690, 243, 241

[56] References Cited

UNITED STATES PATENTS

| | | | |
|---|---|---|---|
| 1,725,439 | 8/1929 | Carns | 52/729 |
| 2,922,201 | 1/1960 | Baker | 52/481 |
| 3,159,235 | 12/1964 | Young et al. | 52/404 |
| 3,423,893 | 1/1969 | Hyatt | 52/347 X |
| 3,482,363 | 12/1969 | Bescher | 52/730 X |

*Primary Examiner*—Price C. Faw, Jr.
*Assistant Examiner*—Carl D. Friedman
*Attorney, Agent, or Firm*—Donnie Rudd; Samuel Kurlandsky; Robert H. Robinson

[57] ABSTRACT

A slotted stud comprising two elongate, spaced-apart, parallel stud portions connected to one another at a point substantially intermediate their ends, and a partition formed by a plurality of such studs arranged in spaced-apart coplanar array and opposed panels mounted on respectively opposed stud portions, and in some embodiments, slotted plates respectively connected to aligned opposite ends of said studs, all of the above configurations contributing to or forming partitions with reduced sound transmission.

2 Claims, 6 Drawing Figures

PARTITION AND STUD THEREFOR

This is a continuation of application Ser. No. 435,078, filed Jan. 1, 1974, now abandoned.

BACKGROUND OF THE INVENTION

1. Field of the Invention

This invention relates to studs and to partitions, and particularly, to studs and to partitions utilizing such studs which reduce the transmission of sound from one space to an adjacent space spearated from the first by the partition wall.

2. Brief Description of the Prior Art

In the past, a variety of stud designs and partition constructions have been devised and utilized to reduce sound transmission through walls and partitions. For example, U.S. Pat. No. 3,090,164 issued May 21, 1963 to Nelsson, and assigned to the assignee of the present invention discloses a resilient runner for attachment to studs in a wall or partition for use in supporting panels on the wall or partition in a manner permitting them to vibrate and resonate substantially independently of the opposite side of the wall, thereby lessening sound transmission through the wall. Another system utilized is the so-called "staggered-stud system" in which the vertical support members or studs are alternately "staggered" or offset laterally along the plate which is of greater width than the studs so that every other support member is coplanar with the panel on one side of the wall while adjacent support members are out of contact with that panel but are in contact with the panel on the opposite side of the wall. This also helps in rendering each side of the wall acoustically independent of the other. While being very effective acoustically, both of these systems and other systems like them involve extra elements, such as the resilient runner, or extra material and labor costs, such as the costs for additional studs (twice as many) and labor to assemble them in a partition constructed utilizing the staggered stud system to get the same support panel spacing between studs or each side of the wall or partition.

In that most walls and partitions used in residential construction incorporate a frame of 2 × 4 wooden support members such as plates and studs, it would be of greater advantage to find a solution to the problem of preventing sound transmission which uses such members. Several notable attempts have been made in improving the sound transmission resistance of a wall by modifying, in one way or another, the form of the wooden support members used in its construction. For example, U.S. Pat. No. 2,922,201, issued on Jan. 26, 1960 to Baker, and assigned to the assignee of the present invention, discloses a partition frame in which the studs are slotted along the portion of their length intermediate their end portions so that the wall panel secured to one side of the stud is acoustically insulated to a high degree from the wall panel secured to the opposite side of the stud. Indeed, a partition so constructed using this stud does exhibit remarkable sound transmission resistance. U.S. Pat. No. 3,482,363, issued on Dec. 9, 1969 to Bescher, discloses a very similar form of such stud in which the ends of two separate elements forming the stud are connected to one another by a separate member such as a bolt or pin, rather than by being left uncut or connected integrally as in the case of U.S. Pat. No. 2,922,201. In addition, U.S. Pat. No. 3,159,235, issued on Dec. 1, 1964 to Young et al., although not directed to stud designs per se, discloses several modifications of the stud of U.S. Pat. No. 2,922,201, in which a plurality of slots are formed, some slots overlapping the others. Obviously, the formation of so many slots along the length of the stud weakens the stud somewhat. In addition, the formation of a great number of separate but parallel slots along the length of the stud increases the cost and manufacturing time of the stud.

In light of the above-mentioned prior art, it was completely unexpected and surprising to discover a stud construction and partition which could be constructed by modifying ordinary 2 × 4 wooden support elements of the traditional type, and yet which would exhibit substantially improved sound transmission resistance compared with the studs and partition constructions mentioned above and particularly those disclosed by U.S. Pat. No. 2,922,201. The present invention can be achieved by either factory or on-site modification of the 2 × 4 wooden construction members and would involve about the same cost of manufacture as the system disclosed in U.S. Pat. No. 2,922,201.

Accordingly, it is a principal object and advantage of the present invention to reduce the sound transmission through a wall or partition.

It is an additional object and advantage of the present invention to enable a wall or partition to be constructed using a modified form of 2 × 4 wooden members and which will acoustically insulate one space from another without any substantial increase in cost.

SUMMARY OF THE INVENTION

The invention is an elongate stud of rectangular cross section having two opposed wide faces and two opposed narrow faces. A vertical section of the stud taken in a plane parallel to the opposed wide faces has the configuration of an elongated H. In some embodiments, the elongate stud comprises an integral member divided into two elongate spaced-apart parallel stud portions integrally connected to one another at a point substantially intermediate their ends. In another embodiment, the elongate spaced-apart parallel stud portions are connected by separate means to one another at a point substantially intermediate their ends. The separate stud portions, spaced from the middle connecting point vibrate or resonate substantially independently of each other and therefore, are substantially acoustically independent of each other. Each of the stud portions has a surface which is opposed to the corresponding surface of the other stud portion and is adapted to engage discrete surface-defining means against which sound waves normally impinge.

The preferred form of the invention involves slots or air spaces through the narrow or thinnest dimension of the rectangular cross section and extending from each end of the stud to a point spaced-apart from the terminal point of the slot extending from the opposite end of the stud so as to form two spaced-apart independently vibration responsive stud portions at each end of the stud.

The invention also is a partition incorporating a plurality of studs having two opposed elongate spaced-apart parallel stud portions in combination with opposed surface-defining means supported by respectively opposed portions of the studs, and means connecting the stud portions to one another at a point substantially intermediate their ends, whereby one stud portion is substantially vibration insulated from the other stud portion. The studs are disposed in spaced-apart coplanar relationship with one another in the partition. A base plate and a top plate, respectively, engage the opposite ends of the spaced-apart studs. In a more preferred embodiment of the invention, such plates have a slot extending from the surface engaged by the studs to the opposite surface, and from substantially one end of the plate to the other.

DESCRIPTION OF THE DRAWINGS

Additional objects and advantages of the present invention will become apparent from the following description thereof, made in conjunction with the drawings, wherein.

DETAILED DESCRIPTION OF THE PREFERRED EMBODIMENTS

Figure 1:
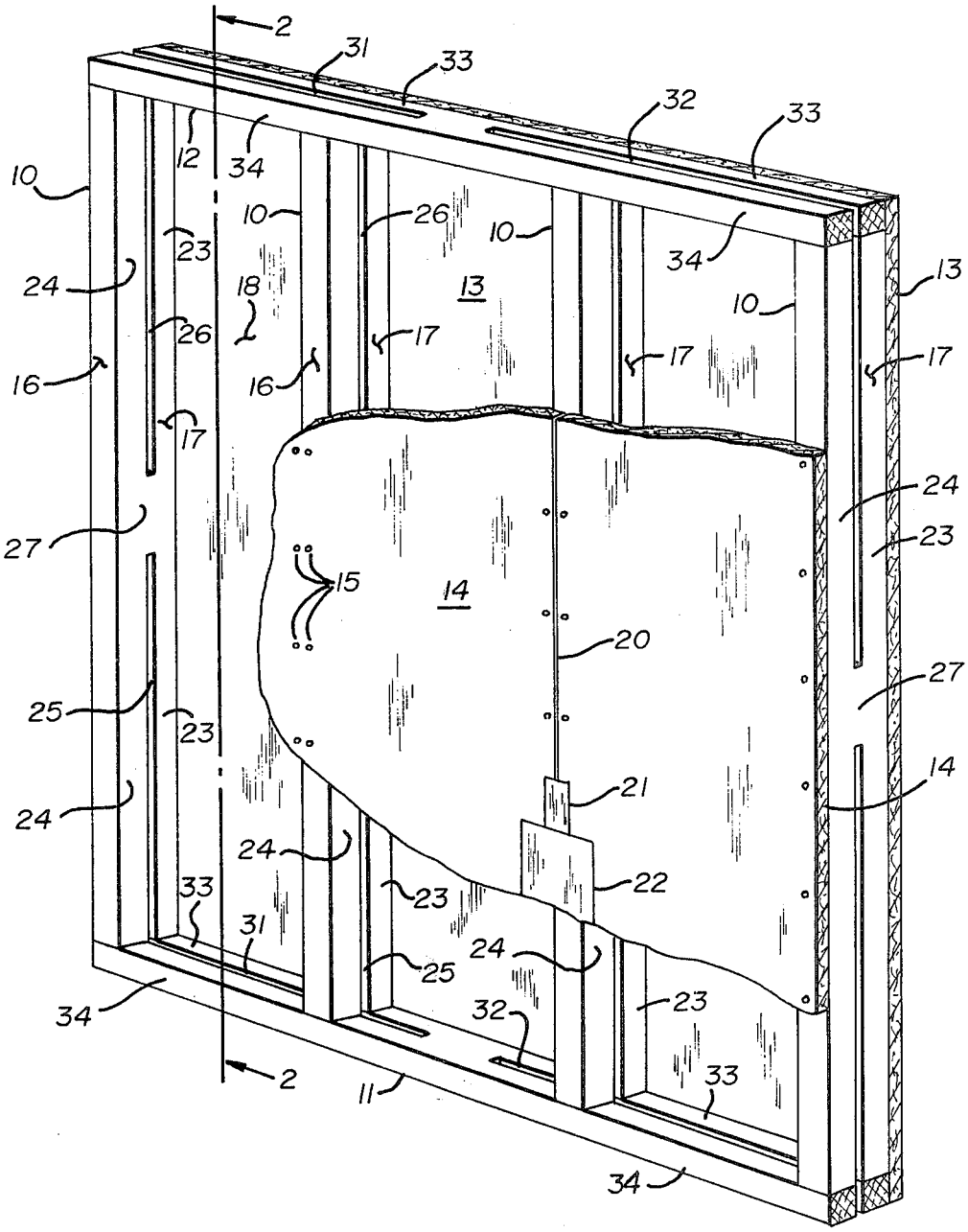
FIG. 1 is a perspective view of a partition of the present invention constructed with studs of the present invention showing only part of the surface-defining panel on the front side thereof.
Figure 2:
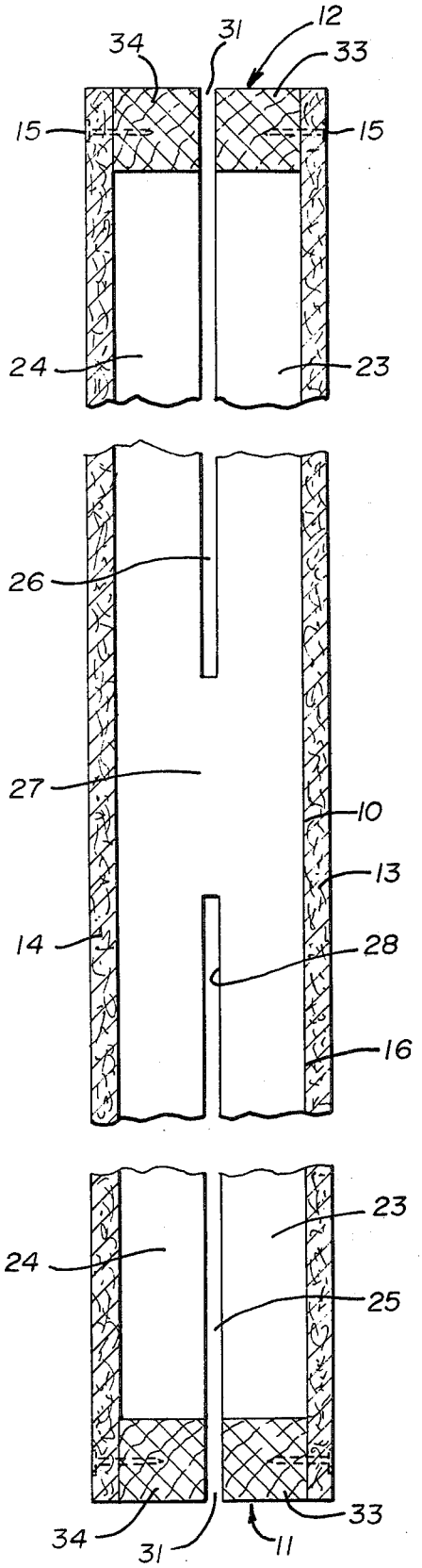
FIG. 2 is a sectional view taken along lines 2—2 of FIG. 1, but modified to show panels on both front and back sides of the partition.

Referring now to the drawings, FIGS. 1 and 2 illustrate a partition of the present invention, suitable for use in an exterior wall or an interior partition wall in a building or dwelling, which incorporates studs of the present invention. In the partition, a plurality of studs 10 are vertically disposed in spaced-apart parallel coplanar array along the partition and extend between a floor plate 11 and a ceiling plate 12 which are affixed to the floor and ceiling, respectively, of a building structure (none of which is shown). The ends of the studs 10 are attached to the floor plate 11 and to the ceiling plate 12, respectively, by means such as nails (not shown) as by "toe nailing" in the usual manner. Surface defining panels 13 and 14, such as gypsum wallboard, are attached by nails 15 to the outwardly facing opposed surfaces 16 of the studs 10. Sound transmission resistance and thermal insulation of the partition is normally improved by the addition of insulating material (not shown) in either "blown" or "batt" form in the cavities defined by the facing surfaces 17 of the studs 10 and the facing surfaces 18 of the panels 13 and 14. The joints 20 between adjoining edges of gypsum wallboard panels 13 and 14 may be finished as by the application of joint tape 21 followed by the application of a layer of joint compound 22 to render the joint 20 or the intersection between panels 13 closed and invisible when painted or decorated. Alternatively, a layer of plaster may be applied to the exterior surfaces of the panels 13 and 14. These and other techniques are well-known to the art and may be employed in constructing partitions in accordance with the present invention. Obviously, many other types of surface-defining means, other than the gypsum wallboard panels 13 and 14 described above, may be employed in partitions of the present invention, the scope of which encompasses any partition using the stud of the invention to which are operably attached surface-defining means such as panels against which sound waves normally impinge. It would certainly include discrete panels of hardboard and plywood, for example.

The studs 10 shown in FIGS. 1 and 2 are the preferred form of stud of the present invention in terms of cost and ease of manufacture. Each stud 10 comprises two elongate spaced-apart stud portions 23 and 24 which are parallel along their length and are connected to one another at a point substantially intermediate their ends. In the embodiment of the stud 10 shown in FIG. 1, the stud portions 23 and 24 are formed by cutting slots 25 and 26 at right angles through the thinnest dimension of an integral 2 × 4 wooden member from each of its ends toward its middle but stopping short of the middle so as to leave an integral uncut portion 27 substantially intermediate its ends which secures the two stud portions 23 and 24 together.

The slots 25 and 26 are preferably disposed centrally of the wide faces of the integral 2 × 4 member so as to divide those slotted portions of the stud into two portions having a substantially equal amount of materia. This provides sufficient wood volume for holding a nail 15 or other securing means for the panels 13 and 14 to be secured to the stud portions. It also provides independently vibratable elements which also have sufficient strength to support panels 13 and 14. It will be apparent that nails 15 or other fasteners should not be so long as to extend from one stud portion to the other through the slot or air gap as this would obviously prevent their independent resonance or vibration.

A vertical section taken along a plane parallel to the wide face of the stud has the configuration of an elongated"H." The stud may comprise any similarly shaped elongate member having opposite ends bifurcated to a point near its middle, with some provision to engage panels or other surface-defining means. It preferably has a rectangular cross section with the narrow faces being adapted to contact the panels and the wider faces being cut to form the slots 25 and 26. This gives maximum structural strength in a direction normal to the resulting wall, and the cutting operation does not involve the removal of so much material as it is performed through the narrow dimension of the stud. The important feature is the formation in the stud of two opposed stud portions having an air space therebetween and which are connected together at a point substantially intermediate their ends, whether by means integral with the stud portions or by separate means.

When the slots 25 and 26 are cut normal to the broad face of the stud 10, the result is the formation of two stud portions 23 and 24 of rectangular cross section having inside facing surfaces 28 and outside opposing surfaces 16 whch become panel supporting surfaces when used in a wall. In the construction of the framework on which the panels 13 and 14 are mounted, the ends of the separate stud portions 23 and 24 of each stud 10, are separately attached, as by nailing in the conventional manner, to the floor plate 11 and the ceiling plate 12, respectively, so that the acoustically insulating effect is achieved along the substantial portion of the length of the stud 10 due to the stud portions 23 and 24 being held in an independently vibration responsive relationship along their length except in the center where they are joined.

In accordance with a preferred embodiment of the present invention, the floor plate 11 and a ceiling plate 12 each have slots 31 and 32, respectively, through their thickness from one wide surface to the other and extending substantially along their entire length. The floor and ceiling plates, 11 and 12, may either be of the configuration of the stud 10 of the present invention described above, or may be of the configuration of the slotted stud disclosed by U.S. Pat. No. 2,922,201 where the two plate portions 33 and 34 thereof are connected only at their ends. Alternatively, since the plates 11 and 12 are normally attached to supports along their length, such as to the floor or to the ceiling itself, the plates 11 and 12 may have plate portions 33 and 34 which are not attached to one other directly, but which are held in spaced-apart parallel position by securement to the floor and to the ceiling as the case may be.

FIG. 2 more clearly indicates the manner in which the stud 10 is disposed relative to the floor plate 11 and to the ceiling plate 12. It can be seen that the ends of separate stud portions 23 and 24 are separately attached to separate plate portions 33 and 34 of the floor plates 11 and the ceiling plate 12, as by nails (not shown). This keeps vibrations near the top and bottom of the wall from being transmitted through the wall by means of the stud, which is otherwise the case where the plates are solid. It is this provision and the maintenance of an air space along substantially the entire length of the stud 10 which provides the improved sound transmission resistance which is exhibited by the resulting preferred partition.

Figure 3:
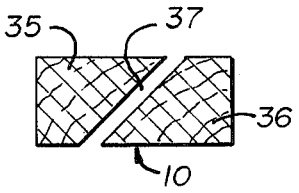
FIGS. 3 and 4 illustrate cross sections of alternative forms of slots in studs of the present invention, useful in forming partitions of the present invention.
Figure 4:
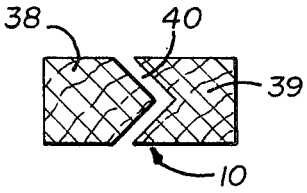

FIGS. 3 and 4 illustrate modified forms of slots 25 and 26 which might be utilized in the stud 10 of the present invention to achieve similar sound transmission reduction. In forming the stud 10 of FIG. 3, the saw cut is made at an acute angle to the wide surface of the stud 10 cross section. The result is the formation of two stud portions 35 and 36 of trapezoidal cross section separated by a gap 37. In FIG. 4, the saw cut is made from wide surface of the stud 10 through approximately one-half of the thickness of the stud 10 to form two stud portions 38 and 39 of varying cross section separated by a slot 40 of V-shaped cross section. While both of these stud configurations achieve good sound transmission reduction, the principle difference is the effect which the particular form of slot has on rigidity, as that varies inversely as the cube of the depth thereof.

Regardless of the particular form of slot used in the stud 10 of the present invention, it is preferred that the length of the slots be such as to leave an uncut portion of the stud at a point intermediate its ends of from about 2 inches to about 12 inches. This means that the terminal points of the slots spaced from the ends of the stud should be spaced-apart from one another by that amount. The lower limit of 2 inches is determined by the amount of wood required to give the stud the requisite strength to stay together during normal handling and assembly, while the upper limit of 12 inches represents the length of attachment of the stud portions, above which substantial degradation in the independence of the stud portions, as far as vibration responsiveness is concerned, could be expected to occur. Obviously, considerable variation in this range is possible and will largely be determined by the type and condition of the wood or other material used in making the stud.

Similarly, the width of the cut or slot forming the gap between the stud portions may vary from a simple saw cut having a width of about ⅛ inch up to a cut formed by other means and having a width of up to about 1 inch, which requires removal of considerable material. Not only does this involve the loss of much material, but it also costs more in work required to form the stud and reduces the strength of the stud when the gap is larger than 1 inch. The important feature is that the gap be sufficiently large to ensure that the two stud portions will vibrate independently of one another when assembled in a wall, but generally the lesser dimensions is preferred for strength and economy.

Figure 5:
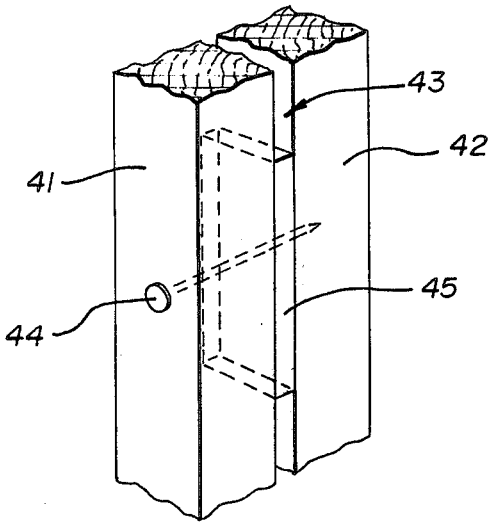
FIGS. 5 and 6 illustrate alternate means of attachment of the two portions of each stud to one another at a point intermediate their ends to form a stud of the present invention.
Figure 6:
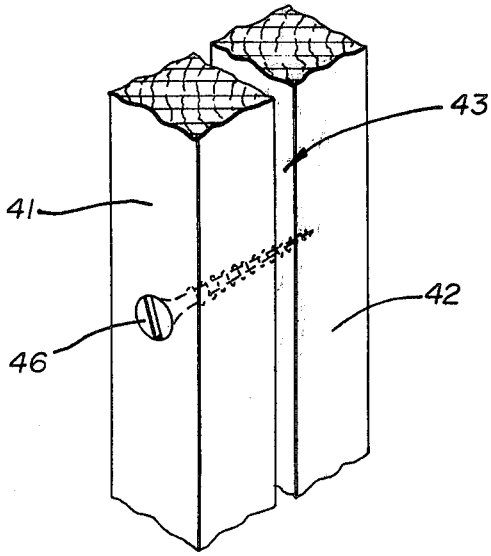

FIGS. 5 and 6 illustrate studs 10 which might be formed through the use of more automated production lines while still achieving the same sound reduction characteristics of the present invention but at slightly higher material cost. In FIG. 5, a normal 2 × 4 is cut into two elongate stud portions 41 and 42 along its entire length and some of the material is removed to leave a gap 43. These portions are rejoined by a fastener 44 through a spacer block 45 which maintains the desired air gap 43 between the two portions 41 and 42 in parallel spaced-apart alignment along their length to preserve the gap 43 while joining them at the point substantially intermediate their ends.

Similarly, FIG. 6 shows a type of screw fastener 46 which can be utilized in the manner taught by U.S. Pat. No. 3,482,363, to maintain the two elongate stud portions 41 and 42 in parallel spaced-apart alignment along their length to preserve the gap 43 while joining them at the point substantially intermediate their ends.

A partition assembly made of studs 10 as shown in FIG. 1, with floor plates 11 and ceiling plates 12 slotted along their length intermediate their ends, having gypsum wallboard panels 13 and 14 mounted on their outer opposite surfces 30 and insulation blankets in the cavity between the panels 13 and 14 and the studs 10, was tested in accordance with ASTM Standard E336-67T to determine its sound transmission loss and the results were compared with a similar test conducted on a similar structure utilizing solid wood studs and solid wood plates. The resulting sound transmission loss of the slotted stud partition of the invention was found to be far superior to that of a solid stud partition. In addition, these results were compared with the results obtained for a wall constructed in accordance with U.S. Pat. No. 2,922,201, where the studs were slotted substantially along their length intermediate their ends, and again, the results for the partition of the present invention were found to be superior to the sound transmission loss for the comparison partition.

Although the precise reason for this unexpectedly discovered improvement achieved by the present invention is not fully understood, it is believed that in the prior art partitions, vibrations received on one wall panel were transmitted through the wall at the top and bottom of the wall where the studs were solid and securely fastened to a solid floor or ceiling plate. The partition of the present invention overcomes this in several ways. First the connection of opposing stud portions over its length when in a wall, any vibrations which may be transmitted through the connection are believed to be dampened by movement of the wall itself. This, of course, reduces sound transmission through the wall. Secondly, the stud portions attached to the plate are separate from one another and so do not transmit vibrations effectively through the plate. This latter feature is further enhanced by the use of a slotted or split plate in which the separate stud portions are separately attached to separate plate portions as shown in FIG. 2. All of these latter features insure far greater insolution or independence of vibration between sides of the resulting partition.

From the above, it can be seen that the present invention provides a new and improved stud which has utility in forming a new and improved partition which exhibits reduced sound transmission. It can be seen that the invention allows conventional materials to be utilized in its construction and involves no dramatic increases in material or labor costs over conventional techniques for constructing partitions. In addition, the stud of the invention provides a convenient and economical way for the passage of wiring and plumbing fixtures through the wall without requiring additional on-site cutting of apertures through the studs.

It will also be readily apparent from the above description of the invention that various modifications in the studs and partitions described in detail herein may be made within the scope of the invention. For example, many different configurations of slots may be employed without effecting the separation of one side of the stud from the other. In addition, the spacing and array of studs shown might be quite different in the construction of the partition without losing the advantages of the present invention. Therefore the invention is not to be limited to the specific details described herein except as may be required by the following claims.

What is claimed is:

1. In a partition having improved resistance to sound transmission, the combination of a plurality of studs, each of said studs comprising two opposed elongate spaced-apart parallel stud portions, and means connecting said stud portions to one another at a point substantially intermediate the ends of said stud, whereby one stud portion is substantially vibration insulated from the other stud portion, said studs being disposed in spaced-apart coplanar relationship with one another, and opposed surface-defining means supported by respectively opposed stud portions of each stud to form a wall;

said partition also including a base plate and a top plate for respectively engaging the opposite ends of said spaced-apart studs, said base plate and said top plate each having an elongate air space extending from the surface engaged by said studs to the opposite surface, and from substantially one end of said plate to the other, so as to define two spaced-apart parallel plate portions in each plate, each plate portion being substantially vibration insulated from the other along its length, and plate portion connecting means connecting said plate portions together at at least one point along the length of said plate.

2. The combination according to claim 1, wherein said plate portion connecting means are integral with said plate portions.

* * * * *